US011572526B2

(12) United States Patent
Amblard et al.

(10) Patent No.: US 11,572,526 B2
(45) Date of Patent: Feb. 7, 2023

(54) LUBRICATING COMPOSITION FOR A MARINE ENGINE OR A STATIONARY ENGINE

(71) Applicant: TOTAL MARKETING SERVICES, Puteaux (FR)

(72) Inventors: Catherine Amblard, Lyons (FR); Christian Gonneaud, Communay (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/339,865

(22) PCT Filed: Oct. 6, 2017

(86) PCT No.: PCT/EP2017/075551
§ 371 (c)(1),
(2) Date: Apr. 5, 2019

(87) PCT Pub. No.: WO2018/065606
PCT Pub. Date: Apr. 12, 2018

(65) Prior Publication Data

US 2020/0040276 A1 Feb. 6, 2020

(30) Foreign Application Priority Data

Oct. 7, 2016 (FR) ..... 1659706

(51) Int. Cl.

| | |
|---|---|
| ***C10M 169/04*** | (2006.01) |
| ***C10M 129/28*** | (2006.01) |
| ***C10M 129/48*** | (2006.01) |
| ***C10M 137/10*** | (2006.01) |
| ***C10M 141/10*** | (2006.01) |
| ***C10M 143/04*** | (2006.01) |
| ***C10M 143/12*** | (2006.01) |
| ***C10M 161/00*** | (2006.01) |
| *C10N 20/00* | (2006.01) |
| *C10N 30/04* | (2006.01) |
| *C10N 30/06* | (2006.01) |
| *C10N 30/18* | (2006.01) |
| *C10N 30/00* | (2006.01) |
| *C10N 40/26* | (2006.01) |

(52) U.S. Cl.

CPC ..... *C10M 169/044* (2013.01); *C10M 129/28* (2013.01); *C10M 129/48* (2013.01); *C10M 137/10* (2013.01); *C10M 141/10* (2013.01); *C10M 143/04* (2013.01); *C10M 143/12* (2013.01); *C10M 161/00* (2013.01); *C10M 2203/003* (2013.01); *C10M 2205/024* (2013.01); *C10M 2205/06* (2013.01); *C10M 2207/12* (2013.01); *C10M 2207/14* (2013.01); *C10M 2223/045* (2013.01); *C10N 2020/069* (2020.05); *C10N 2030/04* (2013.01); *C10N 2030/06* (2013.01); *C10N 2030/18* (2013.01); *C10N 2030/54* (2020.05); *C10N 2040/26* (2013.01)

(58) Field of Classification Search

CPC ..... C10N 2240/105; C10N 2220/027; C10N 2230/54; C10N 2230/04; C10N 2230/06; C10N 2230/18; C10N 2040/26; C10N 2020/02; C10M 2203/003; C10M 2207/12; C10M 2207/14; C10M 2223/045; C10M 2205/024; C10M 2205/06

See application file for complete search history.

(56) References Cited

U.S. PATENT DOCUMENTS

| | | | | |
|---|---|---|---|---|
| 3,554,911 | A | 1/1971 | Schiff et al. | |
| 3,994,815 | A | 11/1976 | Coleman | |
| 8,354,362 | B2 | 1/2013 | Price et al. | |
| 9,637,702 | B2 | 5/2017 | Lancon | |
| 2006/0211586 | A1* | 9/2006 | Huang | C10M 143/00 508/591 |
| 2007/0105731 | A1* | 5/2007 | Chu | C10M 143/00 508/542 |
| 2009/0291871 | A1 | 11/2009 | Chu et al. | |
| 2010/0256030 | A1 | 10/2010 | Hartley et al. | |
| 2014/0235516 | A1 | 8/2014 | Lancon | |
| 2016/0017251 | A1 | 1/2016 | Amblard et al. | |

FOREIGN PATENT DOCUMENTS

| | | | |
|---|---|---|---|
| CN | 101851549 | A | 10/2010 |
| EP | 1 783 197 | A2 | 5/2007 |
| GB | 1 402 094 | A | 8/1975 |
| JP | S48-030708 | A | 4/1973 |
| JP | S48-039203 | A | 11/1973 |
| JP | S51-100104 | A | 9/1976 |
| JP | S57-205493 | A | 12/1982 |

(Continued)

OTHER PUBLICATIONS

International Search Report, dated Nov. 15, 2017, from corresponding PCT application No. PCT/EP2017/075551.

(Continued)

*Primary Examiner* — Vishal V Vasisth

(74) *Attorney, Agent, or Firm* — Nixon & Vanderhye

(57) ABSTRACT

Disclosed is a lubricant composition including: at least one base oil; at least one olefin copolymer; at least one detergent; and at least one hydrogenated and linear styrene/butadiene copolymer. Also disclosed is the use of this composition for reducing the fuel consumption of an engine and for improving the cleanliness of a 4-stroke or 2-stroke, preferably 4-stroke marine engine, or of a stationary engine.

11 Claims, No Drawings

(56) References Cited

FOREIGN PATENT DOCUMENTS

| | | | | | |
|---|---|---|---|---|---|
| JP | 2006-521450 | A | | 9/2006 | |
| JP | 2007-126668 | A | | 5/2007 | |
| JP | 2009-531531 | A | | 9/2009 | |
| JP | 2014-528489 | A | | 10/2014 | |
| WO | 2004/087849 | A1 | | 10/2004 | |
| WO | WO-2004087849 | A1 | * | 10/2004 | ..... C08L 53/025 |
| WO | 2007/121039 | A2 | | 10/2007 | |
| WO | 2013/045648 | A1 | | 4/2013 | |
| WO | 2014/135596 | A1 | | 9/2014 | |

OTHER PUBLICATIONS

French Search Report, dated May 10, 2017, from corresponding FR application No. 1659706.

Lancon et al., "Innovator-4C, The cutting-edge Man B&W 5L16/24 test engine dedicated for validating novel marine lubricants from lubmarine," International Council on Combustion Engines, CIMAC Congress 2004, Kyoto, Paper 124.

Roman, "Research and Development of Marine Lubricants in Elf Antar France—The relevance of laboratory tests in simulating field performance," Marine Propulsion Conference 2000—Amsterdam—Mar. 29-30, 2000.

* cited by examiner

LUBRICATING COMPOSITION FOR A MARINE ENGINE OR A STATIONARY ENGINE

This application is a 371 of PCT/EP2017/07551, filed Oct. 6, 2017.

The present invention is applicable to the field of lubricating compositions, and more particularly to the field of lubricating compositions for a marine engine, notably for a four-stroke or two-stroke marine engine, preferentially for a four-stroke marine engine or for a stationary engine. More particularly, the present invention relates to lubricating compositions, for which the use promotes savings of fuel (fuel-eco or FE or further gas-eco or GE) and having good engine cleanliness properties, notably in case cleanliness. The present invention also relates to a method for reducing the consumption of fuel, notably of fuel, of a ship or of a central unit applying this lubricating composition.

In the field of automobiles, because of environmental issues, it is increasingly sought to reduce polluting emissions and to carry out fuel savings. The nature of the engine lubricants for automobiles has an influence on both of these phenomena, and engine lubricants for automobiles, so called "fuel-eco" engine lubricants have emerged. This is the main quality of lubricant bases, either alone or as a combination with polymers improving the viscosity index and/or the friction modifier additives, which gives the lubricant its "fuel-eco" properties. The fuel savings generated by means of these "fuel-eco" engine lubricants are essentially achieved during the cold starting, when the engine is not yet in a stabilized mode and not at a high temperature in a stabilized mode. In general, the consumption gains in the New European Driving Cycle (NEDC) according to the European directive 70/220/EEC are under cold conditions (urban cycle) of 5%, under hot conditions (extra-urban cycle) of 1.5% for average gains of 2.5%.

Now in the field of marine lubricants, the marine engines operate in stabilized conditions, there are very little cold starts. The "fuel-eco" solutions adapted to automobile engines are therefore not adapted to marine engines. In particular, the consumption gains obtained in the field of the automobile cannot be obtained in the field of marine engines.

Further, the problem of "a fuel-eco" is also put forward in stationary engines of an electric power station.

Moreover, the formulation of a "fuel-eco" and/or "gas-eco" does not have to be made to the detriment of other performances of the lubricant. In particular, the resistance to wear, the de-emulsion, the neutralization capability, and the cleanliness of the engine (piston and/or case) do not have to be altered.

From WO2007/121039 is notably known a lubricant composition comprising a copolymer comprising an olefin block and an aromatic vinyl block and notably its use for reducing the fouling of the engines. From WO 2013/045648 is also known a composition comprising at least one copolymer olefin, at least one hydrogenated styrene-isoprene copolymer, at least one glycerol ester and its use for improving the fuel-eco and for limiting fouling of the engine. Finally from WO2014/135596 a composition is also known, comprising at least one copolymer olefin, at least one hydrogenated styrene-isoprene copolymer, at least one ester of glycerol and its use for improving the fuel-eco and limiting the fouling of the engine.

There is therefore an interest for having a lubricant composition for a marine engine or for a stationary engine which has reductions in consumption of fuels (fuel and/or gas), notably of fuel, satisfying reductions, while maintaining the other performances of the lubricant composition, in particular the cleanliness of the engine, more specifically the cleanliness of the case.

It is also interesting to have a lubricant composition for a marine engine or for a stationary engine having a good thermal resistance under severed conditions of use, and more particularly in the presence of a fuel (fuel and/or gas), notably fuel. Indeed, during the combustion of the fuel or of the gas within the engine, residues and unburnt combustion portions may pollute the lubricating composition and thus alter its thermal resistance and its detergence properties.

A goal of the present invention is therefore to provide a lubricating composition overcoming totally or partly the aforementioned drawbacks. Notably, a goal of the present invention is to provide a lubricating composition for a marine engine or for a stationary engine allowing a fuel (fuel and/or gas) gain, notably a fuel-eco (FE) gain while maintaining the cleanliness of the engine.

Another object of the present invention is to provide a lubrication method allowing combustible savings (fuel and/or gas) notably of fuel while maintaining good engine cleanliness.

Other goals will further appear upon reading the description of the invention which follows.

The object of the invention is thus a lubricating composition comprising:

- at least one base oil;
- at least one detergent;
- at least one olefinic copolymer; and
- at least one hydrogenated and linear styrene-butadiene copolymer.

Surprisingly, the applicant noticed that it was possible to formulate lubricating compositions for marine engines or for stationary engines allowing significant reduction in the consumption of fuels (fuel and/or gas), notably of fuel (Fuel Eco), while maintaining or even improving the motor cleanliness, notably the case cleanliness, as compared with conventional lubricating compositions for marine engines or for stationary engines. This is made possible by means of a lubricating composition comprising at least one base oil, at least one detergent, at least one olefinic copolymer and at least one hydrogenated and linear styrene-butadiene copolymer.

Thus, the present invention gives the possibility of formulating lubricating compositions for a 4-stroke or 2-stroke marine engine, preferably 4-stroke engine, or for a stationary engine, giving the possibility of combining both engine cleanliness and a gain in fuel savings (fuel and/or gas), notably fuel (Fuel Eco).

Advantageously, the lubricating compositions according to the invention have an improved thermal resistance under severed conditions and more particularly in the presence of fuel, notably of fuel.

Advantageously, the lubricant compositions according to the invention have improved storage stability as well as viscosity which does not vary or very little overtime.

In an embodiment of the invention, the hydrogenated and linear styrene/butadiene copolymer may be selected from hydrogenated styrene/butadiene block copolymers or random hydrogenated styrene/butadiene copolymers or mixtures thereof.

Advantageously, the hydrogenated and linear styrene/butadiene copolymer has a content of hydrogenated butadiene units, ranging from 50% to 98% by mass, preferably from 60% to 98%, more preferentially from 60% to 90%, based on the hydrogenated and linear styrene/butadiene copolymer mass.

Advantageously, the hydrogenated and linear styrene/butadiene copolymer has a content of hydrogenated butadiene units, ranging from 50% to 98% by moles, preferably from 60% to 98%, more preferentially from 70 to 97%, more preferentially from 70% to 95%, relatively to the number of hydrogenated and linear styrene/butadiene copolymer moles.

Advantageously, the hydrogenated and linear styrene/butadiene copolymer has a content of styrene units, ranging from 2% to 50%, preferably from 2% to 40%, more preferentially from 10% to 40% by mass based on the mass of hydrogenated and linear styrene/butadiene copolymer.

Advantageously, the hydrogenated and linear styrene/butadiene copolymer has a content of styrene units, ranging from 2% to 50%, preferably from 2% to 40%, more preferentially from 5% to 30% by moles with respect to the number of moles of the hydrogenated and linear styrene/butadiene copolymer.

In an embodiment of the invention, the hydrogenated and linear styrene/butadiene copolymer according to the invention has an average weight molecular weight $M_w$ ranging from 80,000 to 500,000 Daltons, preferably from 80,000 to 250,000 Daltons, more preferentially from 80,000 to 200,000 Daltons, still more preferentially from 80,000 to 150,000 Daltons.

In an embodiment of the invention, the hydrogenated and linear styrene/butadiene copolymer according to the invention has a polydispersity index ranging from 0.8 to 1.4, preferably from 0.8 to 1.2.

In an embodiment of the invention, the hydrogenated butadiene units are formed with 5 to 40% by mass of 1-4 addition butadiene, preferably from 20 to 40% based on the mass of butadiene units in the hydrogenated and linear styrene/butadiene copolymer and from 20 to 60% by mass of 1-2 addition butadiene, preferably from 30 to 60% relatively to the mass of butadiene units in the hydrogenated and linear styrene/butadiene copolymer.

In another embodiment of the invention, the hydrogenated butadiene units are formed with 10 to 60% by moles of 1-4 addition butadiene, preferably from 20 to 50% based on the number of moles of butadiene units in the hydrogenated and linear styrene/butadiene copolymer and from 30 to 80% by moles of 1-2 addition butadiene, preferably from 40 to 60% based on the number of moles of butadiene units in the hydrogenated and linear styrene/butadiene copolymer.

As examples of a hydrogenated and linear styrene/butadiene copolymer according to the invention, it is possible to mention commercial hydrogenated and linear styrene/butadiene polymers marketed by the Lubrizol Corporation.

In an embodiment of the invention, the weight content of hydrogenated and linear styrene/butadiene copolymer in the lubricating composition according to the invention is from 0.01% to 8% by mass, based on the total mass of the lubricating composition, preferably from 0.1% to 5%, more preferentially from 0.1% to 2%, advantageously from 0.1 to 1%. This amount is understood as an amount of active polymeric material. Indeed, the hydrogenated and linear styrene/butadiene copolymer used within the scope of the present invention may have the shape of a dispersion in a mineral or synthetic oil, and more particularly in an oil of group I according to the API classification.

Preferably, the olefinic copolymer is an ethylene-propylene copolymer.

These copolymeric olefins are traditionally copolymers based on ethylene units and on propylene units, or optionally the copolymers based on ethylene units, on propylene units and on diene units (EPDM). Preferably, the copolymeric olefin according to the invention is an ethylene/propylene copolymer.

The copolymer olefin according to the invention is in a linear or star-shaped form, preferably in a linear form. The copolymeric olefin according to the invention is in the form of blocks or under a random form.

The copolymeric olefin according to the invention advantageously has a content of ethylene units, ranging from 30% to 80% by mass, relatively to the mass of copolymeric olefin, preferably from 30% to 70%, more preferentially from 40% to 70%.

The copolymeric olefin according to the invention also advantageously has a content of ethylene units, ranging from 40% to 90% by moles, based on the number of copolymeric olefinic moles, preferably from 40% to 80%, more preferentially from 50% to 80%.

The copolymeric olefin according to the invention advantageously has a content of propylene units, ranging from 20% to 70% by mass, relatively to the copolymeric olefin mass, preferably from 20% to 60%, more preferentially from 20% to 50%.

The copolymeric olefin according to the invention also advantageously has a content of propylene units, ranging from 10% to 60% by moles, relatively to the number of copolymeric olefin moles, preferably from 20% to 60%, more preferentially from 20% to 50%.

The copolymeric olefin according to the invention advantageously has an average molecular mass by weight Mw comprised between 40,000 and 220,000 Daltons, preferably between 60,000 and 220,000 Daltons, more preferentially between 100,000 and 220,000 Daltons, even more preferentially between 140,000 and 210,000 Daltons.

The copolymeric olefin according to the invention advantageously has a polydispersity index comprised between 1.5 and 5, preferably between 2 and 5, more preferentially between 2 and 4, even more preferentially between 2 and 3.5.

The amount of copolymeric olefin in the lubricant composition according to the invention is from 0.01% to 5% by mass, based on the total mass of the lubricant composition, preferably from 0.01% to 2%, more preferentially from 0.01% to 1%, even more preferentially from 0.1% to 1%. This amount is understood as an amount of dry polymeric material. Indeed, the copolymeric olefin used within the scope of the present invention is sometimes found diluted in a mineral or synthetic oil (most often an oil of group 1 according to the API classification).

In an embodiment, the lubricant composition according to the invention may comprise at least one detergent.

The detergents used in the lubricating compositions according to the present invention are well known to one skilled in the art.

The detergents commonly used in the formulation of lubricant compositions are typically anionic compounds including a long lipophilic hydrocarbon chain and a hydrophilic head.

The associated cation is typically a metal cation of an alkaline or earth-alkaline metal.

The detergents according to the invention are selected from the salts of alkaline metals or earth-alkaline metals of carboxylic acids, of sulfonates, of salicylates, of naphthenates, and of phenates taken alone or as a mixture. The detergents are named according to the nature of the hydrophobic chain, carboxylate, sulfonate, salicylate, naphthenate or phenate.

The alkaline and earth-alkaline metals are preferentially calcium, magnesium, sodium or barium, more preferentially calcium.

The used detergents will be non-overbased (or neutral) or overbased. These are referred to as non-overbased or «neutral» detergents when the metal salts contain the metal in an approximately stoichiometric amount. These are referred to as overbased detergents, when the metal is in excess (in an amount greater than the stoichiometric amount). The excess metal providing the overbased character to the detergent appears as insoluble metal salts in oil. The overbased detergents thus appear in the form of micelles consisting of insoluble metal salts maintained in suspension in the lubricant composition by the detergents in the form of soluble metal salts in oil. These micelles may contain one or several types of insoluble metal salts, stabilized with one or several types of detergents.

The overbased detergents will be of the mixed type if the micelles comprise several types of detergents, different from each other by the nature of their hydrophobic chain.

The preferred detergents are carboxylates, sulfonates and/or phenates, taken alone or as a mixture, in particular calcium carboxylates, calcium sulfonates and/or calcium phenates.

The amount of detergents in the lubricating composition according to the invention is from 1% to 30% by mass, based on the total mass of the lubricating composition, preferably from 1% to 25%, more preferentially from 1% to 20%, still more preferentially from 3% to 20%.

Preferably, the amount of detergents in the lubricating composition according to the invention is from 10% to 30%, preferably from 10% to 25%, and more preferentially from 10% to 20%, by mass, based on the total mass of the lubricating composition.

The BN (Base Number measured according to ASTM D-2896) of the lubricant compositions according to this invention is provided in whole or in part by neutral overbased detergents based on alkaline or alkaline Earth metals.

The BN of the lubricant compositions of the invention, measured according to ASTM D-2896, may range from 3-140 mg KOH/g, preferably 3-80 mg KOH/g, more preferably 4-60 mg KOH/g. The BN will be selected based on the conditions in which the lubricant compositions will be used, in particular based on the sulphur content of the fuel used.

Thus, for heavy fuels with a sulphur content from 0.1-3.5 wt. %, the BN of the composition will be between 20 and 80 KOH/g, more preferably between 20 and 65 mg KOH/g. These compositions are preferably used in 4T marine engines or stationary engines.

Thus, for heavy fuels with a sulphur content from 0.1-3.5 wt. % as well, the BN of the composition will be between 20 and 140 KOH/g, more preferably between 20 and 100 mg KOH/g. These compositions are preferably used in 2T marine engines, in particular as cylinder oils.

For gas oils with a sulfur content ranging from 0.05% to 2% by weight, the BN value of the composition is comprised between 5 and 30 mg of KOH/g, more preferentially between 10 and 20 mg of KOH/g. These compositions are preferably applied in 4T marine engines or in stationary engines.

For gases, the BN value of the composition is less than 10 mg of KOH/g, more preferentially between 2 and 8 mg of KOH/g. These compositions are preferably applied in 4T marine engines or in stationary engines.

In the following of the present invention, essential additives will be called the additives described above i.e. a) at least one copolymeric olefin, b) of at least one hydrogenated and linear styrene and butadiene copolymer, c) at least one detergent as defined above.

Generally, the base oils used for the formulation of lubricating compositions according to the invention may be selected from oils of mineral, synthetic or vegetable origin as well as their mixtures.

The mineral or synthetic oils generally used in the oil-marine application belong to one of the classes defined in the API classification as summarized in the table below.

| | Content of saturated substances | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydro-isomerized oils | ≥90% | ≤0.03% | ≥120 |
| Group IV | Poly-Alpha-Olefins (PAO) | | |
| Group V | Other bases not included in the bases of groups I to IV | | |

The mineral oils of Group I may be obtained by distillation of selected naphthenic or paraffinic crudes and then by purification of these distillates with methods such as solvent extraction, de-paraffination with a solvent or catalytic de-paraffination, hydro-treatment or hydrogenation. The mineral bases of Group I are for example bases called Neutral Solvent (such as for example 150NS, 330NS, 500NS or 600NS) or Brightstock.

The oils of the Groups II and III are obtained by more severe purification methods, for example by a combination from among hydro-treatment, hydrocracking, hydrogenation and catalytic deparaffination.

The examples of synthetic bases of Group IV and V include poly-alpha olefins, polybutenes, polyisobutenes, alkylbenzenes.

These base oils may be used alone or as a mixture. A mineral oil may be combined with a synthetic oil.

In a preferred embodiment of the invention, the lubricant base oil is selected from among base oils of the group I or of the group II, taken alone or as a mixture.

In an embodiment of the invention, the lubricant composition according to the invention may be characterized by a viscosimetric grade SAE-20, SAE-30, SAE-40, SAE-50 or SAE-60 according to the SAEJ300 classification, preferably SAE-30 or SAE-40, advantageously SAE-30.

The oils of grade 20 have a cinematic viscosity at 100° C. comprised between 5.6 and 9.3 cSt. The oils of grade 30 have a cinematic viscosity at 100° C. comprised between 9.3 and 12.5 cSt. The oils of grade 40 have a cinematic viscosity at 100° C. comprised between 12.5 and 16.3 cSt. The oils of grade 50 have a cinematic viscosity at 100° C. comprised between 16.3 and 21.9 cSt. The oils of grade 60 have a cinematic viscosity at 100° C. comprised between 21.9 and 26.1 cSt.

The cinematic viscosity is measured according to the ASTM D7279 standard at 100° C.

In a preferred embodiment, the lubricating composition according to the invention has a cinematic viscosity measured according to the ASTM D7279 standard at 100° C.

comprised between 5.6 and 26.1 cSt, preferably between 9.3 and 21.9 cSt, more preferentially between 9.3 and 16.3 cSt.

In an embodiment of the invention, the weight content of base oil in the lubricating composition according to the invention is from 40% to 95%, preferably from 50% to 95%, more preferentially from 60% to 95%, advantageously from 60 to 85% based on the total weight of the lubricating composition.

In an embodiment, the lubricating composition does not appear as an emulsion.

In addition to the essential additives as described above, the composition according to the invention may comprise at least one optional additive, notably selected from among those currently used by one skilled in the art. For example, the optional additive may be selected from among dispersant additives, anti-wear additives, antioxidants, friction modifiers, pour point improvement agents, anti-foam agents, thickeners, fatty amines and mixtures thereof. The latter are well known to one skilled in the art.

In an embodiment, the lubricating composition according to the invention may further comprise a dispersant.

Dispersants are additives well known used in the formulation of lubricating compositions, notably for application in the marine field. Their primary role is to maintain in suspension the particles initially present or appearing in the lubricant composition during its use in the engine. They prevent their agglomeration by acting on the steric hindrance. They may also have a synergistic effect on neutralization.

The dispersants used as additives for a lubricant typically contain a polar group, associated with a relatively long hydrocarbon chain, containing from 50 to 400 carbon atoms. The polar group typically contains at least one nitrogen, oxygen or phosphorus element.

In an embodiment of the invention, the dispersant may be selected from derivatives of succinic acid. From among the derivatives of succinic acid, is meant in the sense of the invention, the esters of succinic acid or the amide esters of succinic acid.

Preferably, the dispersant is selected from among compounds comprising at least one succinimide group.

These compounds may then be treated with different compounds notably sulfur, oxygen, formaldehyde, carboxylic acids and compounds containing boron or zinc for example producing borate succinimides or blocked succinimides with zinc.

In a preferred embodiment of the invention, the dispersant is selected from the borate compounds comprising at least one succinimide group.

In a preferred embodiment of the invention, the dispersant may be selected from borate compounds comprising at least one substituted succinimide group or borate compounds comprising at least two substituted succinimide groups, the succinimide groups may be connected at their apex bearing a nitrogen atom by a polyamine group.

By substituted succinimide group in the sense of the present invention, is meant a succinimide group for which at least one of the apices is substituted with a hydrocarbon group comprising from 8 to 400 carbon atoms.

Advantageously, the dispersant is selected from borate compounds comprising at least one succinimide group substituted with a polyisobutene group.

Advantageously, the dispersant is selected from borate compounds comprising at least two substituted succinimide groups each with a polyisobutene group.

More advantageously, the dispersant is selected from among borate compounds comprising at least two substituted succinimide groups each with a polyisobutene group and characterized by:

- A number molecular mass of the polyisobutene greater than 2,000 Daltons, preferably ranging from 2,000 to 5,000 Daltons, advantageously from 2,000 to 3,000 Daltons,
- A boron element mass content greater than or equal to 0.35% based on the total mass of the dispersant.

Mannich bases, obtained by polycondensation of phenols substituted with alkyl, formaldehyde and primary or secondary amine groups, may also be used as a dispersant in the lubricant composition according to the invention.

In an embodiment of the invention, the weight content of dispersant is of at least 0.1%, preferably from 0.1% to 10%, advantageously from 1% to 6% based on the total weight of the lubricant composition.

The anti-wear additives protect sliding surfaces by forming a protective film that is adsorbed on these surfaces. There is a wide variety of anti-wear additives. These include, e.g., phosphosulphurous additives such as metal alkylthiophosphates, in particular zinc alkylthiophosphates, more specifically zinc zinc (or ZnDTP). The alkyl groups of these zinc dialkyldithiophosphates preferably include 1-18 carbon atoms. Amine phosphates, polysulphides, in particular sulphurous olefins, are also commonly used anti-wear additives. There are also nitrogenous and sulphurous anti-wear additives such as metal dithiocarbamates, in particular molybdenum dithiocarbamates. The preferred anti-wear additive is ZnDTP.

The content by weight of the anti-wear additive in the lubricant according to the invention is 0.1-5%, preferably 0.2-4%, more preferably 0.2-2% by the total weight of the lubricant composition.

For example, for pour point improving additives, polymethacrylates (PMAs) may be used.

The lubricant composition of the invention may also comprise friction modifiers. Friction modifiers allow the friction between engine parts to be reduced to the extent possible. These additives help to prevent engine damage whilst improving fuel economy. They may be selected from amongst the organic molecules with a polar moiety at one end: carboxylic acid and derivatives, glycerol ester, imides, fatty amides, fatty amines and derivatives, phosphoric or phosphonic acid derivatives (amine phosphate or phosphate). They act by reacting chemically on the metal surface or by absorption on the metal surface (hydrogen bond).

Another type of friction modifier may be selected from amongst the organometallic compounds: molybdenum dithiophosphate, molybdenum dithiocarbamate, copper oleate, copper salicylate.

Finally, the friction modifier may be a solid compound: the most common are molybdenum disulphide MoS2, boron nitride, and polytetrafluoroethylene (PTFE).

The content by weight of the friction modifier in the lubricant according to the invention is 0.1-5%, preferably 0.2-4%, more preferably 0.2-2% by the total weight of the lubricant composition.

Defoaming additives may be selected from amongst the polar polymers such as polymethylsiloxanes or polyacrylates.

These additives are generally present in an amount by weight of 0.01 to 3% relative to the total weight of the lubricant composition.

Additives to the lubricant composition may also be selected from the fatty amines, in particular at least one fatty amine of formula (I):

$$R_1—[(NR_2)—R_3]—NR_4R_5,$$

wherein $R_1$ is a saturated or unsaturated, linear or branched hydrocarbon group comprising at least 12 carbon atoms and optionally at least one heteroatom selected from nitrogen, sulphur, or oxygen, $R_2$, $R_4$, or $R_5$ independently represent a hydrogen atom or a saturated or unsatured, linear or branched hydrocarbon group, optionally comprising at least one heteroatom selected from nitrogen, sulphur, or oxygen, R3 is a saturated or unsaturated, linear or branched hydrocarbon group comprising one or more carbon atoms and optionally at least one heteroatom selected from nitrogen, sulphur, or oxygen, preferably oxygen, n is greater than equal to 0, preferably n is greater than equal to 1, more preferably an integer between 1 and 10, even more preferably between 1 and 6, and is advantageously selected from 1, 2, or 3.

Preferably, the fatty amine may be selected from mixtures of fatty polyalkylamines comprising one or several polyalkylamines of formulae (II) and/or (III):

(II)

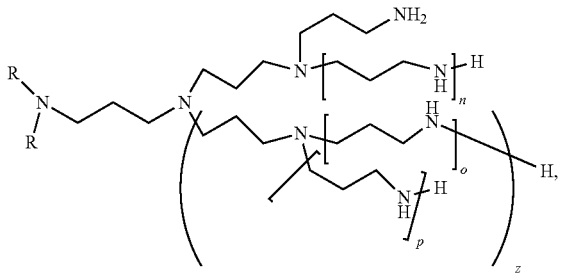

(III)

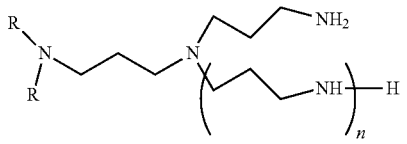

wherein

R, either identical or different, represents a linear or branched alkyl group comprising from 8 to 22 carbon atoms, n and z, independently of each other represent 0, 1, 2 or 3, and when z is greater than 0, o and p, independently of each other represent 0, 1, 2 or 3, said mixture comprising at least 3% by weight of branched compounds such as at least one of n or z is greater than or equal to 1, or of their derivatives.

In an embodiment, the mass percentage of fatty amine is comprised between 1 and 15% based on the total weight of the lubricant composition, preferably between 1 and 10%.

Preferably, the lubricant composition according to the invention comprises:

from 0.01% to 8% by mass of a hydrogenated and linear styrene/butadiene copolymer, preferably from 0.1% to 5%, more preferentially from 0.1% to 2%, advantageously from 0.1 to 1%;

from 0.01% to 5% by mass of a copolymeric olefin, preferably from 0.01% to 2%, more preferentially from 0.01% to 1%, even more preferentially from 0.1% to 1%;

from 1% to 30% by mass of detergent, preferably from 1% to 25%, more preferentially from 1% to 20%, even more preferentially from 3% to 20%.

Preferably, the lubricant composition according to the invention comprises:

from 0.01% to 8% by mass of a hydrogenated and linear styrene/butadiene copolymer, preferably from 0.1% to 5%, more preferentially from 0.1% to 2%, advantageously from 0.1 to 1%;

from 0.01% to 5% by mass of a copolymeric olefin, preferably from 0.01% to 2%, more preferentially from 0.01% to 1%, even more preferentially from 0.1% to 1%;

from 10% to 30% by mass of detergent, preferably from 10% to 25%, and more preferentially from 10% to 20%.

As mentioned above:

the amount of hydrogenated and linear styrene/butadiene copolymer is meant in an amount of active polymeric material;

the amount of olefin copolymer is understood as an amount of active polymeric material.

Advantageously, the lubricant composition according to the invention allows a gain in fuel (fuel-eco and/or gas-eco) greater than from 0.7% to 75% of load, preferably from at least 0.8% to 75% of load, more preferentially of at least 0.9% to 75% of load.

Advantageously, the lubricant composition according to the invention also allows a gain in fuel (fuel-eco and/or gas-eco) of at least 0.9% to 100% of load, preferably of at least 1.0% to 100% of load.

The lubricant composition according to the invention may advantageously be used in marine engines, 4-stroke or 2-stroke, preferably 4-stroke, or stationary engines.

In a preferred embodiment, the lubricant composition is used in high or medium-speed 4-stroke engines that run respectively on bunker fuel or heavy fuel, as well as gas. They may also be used as electrical generators on board large ships or in stationary engines of diesel-electric power stations.

In particular, the lubricant composition is suited for 4-stroke motors as a trunk piston engine oil also known as TPEO.

In particular, the lubricant composition is suitable for 2-stroke engines as a system oil or cylinder oil.

In particular, the lubricant composition is suitable for stationary engines as a piston oil for a trunk piston engine also called a TPEO oil.

Thus, the invention also relates to an oil for a trunk piston engine also called a TPEO (Trunk Piston Engine Oil) oil comprising a lubricant composition as defined above.

By piston oil for a trunk piston engine also called a TPEO oil according to the invention, is meant any lubricant composition intended for lubricating 4-stroke marine engines or stationary engines, notably of the case and of the cylinders.

The invention also relates to a cylinder oil comprising a lubricant composition as defined above.

By cylinder oil according to the invention, is meant any lubricant composition intended for lubricating cylinders of 2-stroke marine engines.

The invention also relates to a system oil comprising a lubricant composition as defined above.

By system oil according to the invention, is meant any lubricant composition intended for lubricating the low portion of 2-stroke marine engines, notably crankshaft pins, of the cam shaft and of bearings of the crankshaft. The system oil also protects the case and cools the piston heads.

Moreover, it is also used as a hydraulic fluid.

The invention also relates to the use of a lubricant composition as defined above for lubricating 4-stroke or 2-stroke marine engines or stationary engines. In a preferred embodiment, the invention relates to the use of a lubricant composition as defined above for lubricating 4-stroke marine engines or stationary engines.

The whole of the characteristics and preferences exhibited by the lubricant composition is applied to the use above.

The invention also relates to the use of a lubricant composition as defined above for reducing the consumption of fuel (fuel and/or gas), notably fuel, in an engine, notably 4-stroke or 2-stroke marine engines or stationary engines, while improving the engine cleanliness, preferably the case cleanliness.

In a preferred embodiment, the invention relates to the use of a lubricant composition as defined above for reducing the fuel consumption, notably of the fuel of 4-stroke marine engines or of stationary engines, while improving the engine cleanliness, preferably the case cleanliness.

The reduction in the fuel consumption, notably of fuel, is notably evaluated by tests on an engine bench or by evaluating the traction coefficient on a test machine, notably on a MTM (Mini Traction Machine) machine.

The engine cleanliness is notably evaluated by the continuous ECBT methods.

The whole of the characteristics and preferences exhibited by the lubricant composition is applied to the use above.

The compounds as defined above contained in the lubricant composition according to the invention, and more particularly the olefin copolymer and the hydrogenated styrene/butadiene copolymer may be incorporated into the lubricant composition as distinct additives, notably by distinctly adding the latter into the base oils.

However, they may also be integrated into a concentrate of additives for a marine lubricant composition or for a lubricant composition of a stationary engine.

Thus, the invention also relates to a composition of the type of additive concentrate comprising:

- at least one detergent,
- at least one olefinic copolymer,
- at least one hydrogenated and linear styrene/butadiene copolymer.

The whole of the characteristics and preferences exhibited for the detergent, the olefinic copolymer and the hydrogenated and linear styrene/butadiene copolymer is also applied to the composition above.

In an embodiment of the invention, to the composition of the additive concentrate type according to the invention may be added at least one base oil for obtaining a lubricant composition according to the invention.

Another object of the invention relates to a method for reducing the fuel consumption, notably of fuel, and improving the engine cleanliness, notably the case cleanliness comprising the putting into contact of the lubricant composition as defined above or obtained from the concentrate as defined above, with a marine engine or a stationary engine.

The set of characteristics and preferences presented for the lubricant composition or for the additive concentrate type composition also applies to the lubrication process according to the invention.

The various objects of the present invention and their implementations will be better understood on reading the examples which follow. These examples are given for information only, and are not limiting in nature.

EXAMPLES

The compositions $C_1$, $O_2$, $L_1$, $L_2$ and $L_3$ are obtained from the following components:

The olefinic copolymer applied in the example comprises 67% by moles of ethylene units and 33% by moles of propylene units, 58% by mass of ethylene units and 42% by mass of propylene units, and has a mass average molecular mass comprised between 170,000 Da and 200,000 Da. They have a viscosity at 100° C. of 4,500 cSt when it is diluted to a content of 7% by mass in an oil of group 1.

The commercial olefinic copolymer is diluted to 5% by mass in a base oil of group 1 for the compositions $L_1$ and $L_3$.

The commercial olefinic copolymer is diluted to 2.3% by mass in a base oil of group 1 for the composition $L_2$.

The hydrogenated and linear styrene-butadiene copolymer applied in the examples comprises 82% by moles of hydrogenated butadiene units (including 32% by moles of addition 1-4 butadiene units and 50% by moles of 1-2 addition butadiene units) and 18% by moles of styrene units, 72% by mass of hydrogenated butadiene units (including 28% by mass of 1-4 addition butadiene units and 44% by mass of 1-2 addition butadiene units) and 29% by mass of styrene units.

It has a mass average molecular mass comprised between 120,000 Da and 150,000 Da and has a polydispersity index comprised between 1 and 1.1.

The commercial hydrogenated and linear styrene-butadiene copolymer is diluted to 8% by mass in a base oil of group 1 for the compositions $L_1$, $L_2$ and $L_3$.

- a detergent packet 1 comprising detergents based on calcium carboxylates, calcium phenates, an anti-wear additive, zinc dithiophosphate (ZnDTP), an anti-foam agent and a friction modifier, the packet being diluted between 40 and 60% by mass in a base oil of group 1,
- a detergent packet 2 comprising detergents based on calcium carboxylates, calcium phenates, an anti-wear additive, zinc dithiophosphate (ZnDTP), an anti-foam agent, the packet being diluted between 40 and 60% by mass, in a base oil of group 1,
- base oils of group 2, in particular the bases known as 100R and 220R, respectively with a viscosity of 4.1 cSt and 6.4 cSt at 100° C., and 20.2 cSt and 41.5 cSt at 40° C.
- base oils of group 1, in particular bases known as Neutral Solvant 100NS and 150NS, having a respective viscosity of 4.1 cSt and 5.3 cSt at 100° C. and 20.2 cSt and 31.0 cSt at 40° C.

The composition $C_3$ is obtained from the following components:

- a hydrogenated styrene/isoprene (HIS) star copolymer comprising 90 mass % hydrogenated isoprene units and 10 mass % styrene units, having a mass Mw equal to 605,000, a mass Mn equal to 439,500, a polydispersity index of 1.4; the commercial copolymer is diluted to 10.7 Mass % in a base oil of group 1,
- a linear olefin copolymer (OCP) comprising 50 mass % ethylene units, with a mass Mw equal to 171,700, a mass Mn equal to 91,120, a polydispersity index of 1.9; the commercial copolymer is diluted to 12.5 mass % in a base oil of group 1, a package comprising calcium carboxylate-, calcium sulphonate-, and calcium phenate-based detergents with an anti-wear additive, ZnDTP, the package being diluted to 50 mass % in a group 1 base oil, base oils of group 1, in particular the bases known as Neutral Solvant 150NS and 33NS, respectively with a viscosity of 30 and 66 cSt at 40° C.

The percent amounts of the various components are indicated in tables Ia and Ib below as mass % of the diluted products used, and not of the active material.

Example 1: Evaluation of the Temperature Resistance Properties of Lubricant Compositions of the Invention This is an evaluation of the temperature resistance of lubricant compositions according to the invention by means of the continuous ECBT test, thus simulating the cleanliness of the engine in the presence of such compositions.

The following lubricant compositions were tested; the percentages given correspond to percent by mass.

Tables Ia and Ib

TABLE Ia

| | Compositions | | | | |
|---|---|---|---|---|---|
| | $C_1$ (comparative) | $C_2$ (comparative) | L1 (invention) | $L_2$ (invention) | $L_3$ (invention) |
| Group 1 base oils | 64.20 | 70.20 | 71.77 | — | 72.27 |
| Group 2 base oils | — | — | — | 65.76 | — |
| Detergent package 1 | — | — | 16.33 | 16.33 | — |
| Detergent package 2 | 15.80 | 15.80 | | — | 15.83 |
| Linear hydrogenated styrene/butadiene copolymer (8 wt. % in base oil) | 20 | | 6.9 | 6.9 | 6.9 |
| Olefin copolymer (5 wt. % in base oil) | — | 14 | 5 | — | 5 |
| Olefin copolymer (2.3 wt. % in base oil) | — | — | — | 11.01 | — |

TABLE Ib

| | Composition C3 (comparative) |
|---|---|
| HIS | 5 |
| OCP | 2.5 |
| Detergent | 12.7 |
| ZnDTP | 0.5 |
| 150NS | 27.3 |
| 330NS | 52.0 |

The physical and chemical characteristics of the compositions of tables Ia and Ib are described in table II.

TABLE II

| | Compositions | | | | | |
|---|---|---|---|---|---|---|
| | C1 (comparative) | C2 (comparative) | L1 (invention) | L2 (invention) | L3 (invention) | C3 (comparative) |
| Kinematic viscosity in $mm^2/s$ (measured at 100° C. per ASTM D7279) | 13.95 | 13.77 | 11.06 | 10.8 | 10.93 | 14.30 |
| Kinematic viscosity in $mm^2/s$ (measured at 40° C. per ASTM D7279) | 87.28 | 92.24 | 72.34 | 66.8 | 69.69 | 109.3 |
| Viscosity index (VI) (calculated per ISO2908) | 164.5 | 152 | 144 | 154 | 147 | 133 |
| HTHS viscosity (in mPa.s per ASTM D4683) | 3.54 | 3.54 | 3.1 | 3.01 | 3.07 | 3.85 |
| BN (per ASTM D2896 in mgKOH/g) | 30.1 | 30.2 | 29.7 | 30.5 | 29.8 | 29.8 |

The temperature resistance of the compositions was thus evaluated using the continuous ECBT test, which measures the mass of deposits (in mg) generated in determined conditions. The lower this mass, the lower the temperature resistance, i.e., the better the cleanliness of the engine.

This test simulates an engine piston that has been brought to a high temperature and on which the lubricant from the casing has been projected.

The test uses aluminum beakers that simulate the shape of pistons. These beakers were placed in a glass container, kept at a controlled temperature by water circulation at 20° C.

The lubricant was placed in these containers, which were equipped with a metal brush partially immersed in the lubricant. This brush was moved by rotation at a speed of 1000 rpm, creating a projection of lubricant on the lower surface of the beaker. The beaker was kept at a temperature of 310° C. by an electrical heating resistance regulated by a thermocouple.

In the continuous ECBT test, the test has a duration of 12 h, and the projection of the lubricant was continuous. This procedure simulates the formation of deposits in the piston-ring assembly. The result is the weight of the deposits measured on the beaker.

A detailed description of this test can be found in the publication "Research and Development of Marine Lubricants in ELF ANTAR France—The relevance of laboratory tests in simulatingfield performance", by Jean-Philippe ROMAN, MARINE PROPULSION CONFERENCE 2000—AMSTERDAM—29-30 Mar. 2000.

The results are grouped in table III below.

TABLE III

| | Compositions | | | | | |
|---|---|---|---|---|---|---|
| | $C_1$ (comparative) | $C_2$ (comparative) | $L_1$ (invention) | $L_2$ (invention) | $L_3$ (invention) | $C_3$ (comparative) |
| Continuous ECBT (mg) (beaker deposition mass) | 453 | 779 | 471 | 553 | 433 | 600 |

The results show that the compositions according to the invention have a good heat resistance and thereby give the possibility of improving the engine cleanliness.

It should be noted that the lubricant compositions have improved heat resistance as compared with lubricant compositions comprising a single olefin copolymer and with lubricant compositions comprising an olefin copolymer in combination with a hydrogenated styrene-isoprene copolymer.

Example 2: Evaluation of the Fuel Consumption Saving Properties of Lubricant Compositions According to the Invention Here the problem is to determine, by simulation, the fuel consumption saving properties by the use of lubricant compositions according to the invention, by evaluating the traction coefficient on a MTM (Mini Traction Machine) machine according to the method described below. The tests were carried out on an MTM PCS machine in bead contact 10006 (standard steel AISI 52100) ultra polished with a diameter equal to 19.05 mm against a flat disc having the same material and surface condition characteristics as the beads.

The following conditions were determined for their representativity of the engine operation in the SPC (Segment Piston Sleeve) area, the SPC area being the area of the engine in which the greater portion of friction takes place and therefore the area in which the fuel consumption gain may be maximized:

load on the 25N bead, driving speed of 1 m/s,

SRR (slipping/rolling ratio) of 100%, this ratio being equivalent to the slipping speed/rolling speed ratio, temperature of 90° C.

Thus, under these conditions, the measured traction coefficient gives the possibility of efficiently predicting the fuel consumption gain of a lubricant composition; the lower the traction coefficient, better is the fuel consumption gain.

The compositions were evaluated according to the method below; the results representing the traction coefficient of each composition are grouped in table IV.

TABLE IV

| | Compositions | | | | |
|---|---|---|---|---|---|
| | $C_1$ (comparative) | $C_2$ (comparative) | $L_1$ (invention) | $L_2$ (invention) | $L_3$ (invention) |
| Traction coefficient | 0.036 | 0.036 | 0.032 | 0.031 | 0.032 |

The traction coefficient for the compositions according to the invention is reduced relatively to the comparative compositions $C_1$ and $C_2$.

It is therefore observed that the association of an olefin copolymer and of a styrene-hydrogenated and linear butadiene copolymer gives the possibility of reducing the traction coefficient and thus gives the possibility of reducing friction.

Example 3: Evaluation of the Fuel Consumption Saving Properties of Lubricant Compositions According to the Invention The fuel saving properties of the lubricant compositions according to the invention were validated by a test conducted on a bench equipped with an engine MAN 5L16/24. The particular features of this engine were described in the publication entitled "INNOVATOR-4C, The cutting-edge MAN B&W 5L16/24 test engine", by D. Lançon, V. Doyen and J. Christensen, CIMAC Congress 2004, KYOTO (Paper 124).

A procedure dedicated to the stabilized conditions was developed by measuring the "fuel eco" properties of lubricant compositions according to the description hereafter. This procedure resorts to pieces of equipment which are usually found in test centers on an engine bench:

Rinsing of the engine and of the lubrication circuits with the candidate lubricant, Running in of the engine with the candidate lubricant, Measurement of the fuel consumption of the distillate type (marine diesel oil—according to the specification ISO8217). The measurements are repeated so as to be sure of the accuracy, The fuel consumptions obtained with the candidate lubricant are compared with those obtained when a reference lubricant is tested under the same conditions, The operating conditions of the engine are:

Speed: 1,000 rpm,

Developed power: 100%, 75% and 25% of the maximum power,

Temperature of the lubricant at the engine inlet: 68-70° C.,

Lubricant volume: 2×200 litres,

The tests are organized according to a specific procedure which consists of regulating any test conducted with a candidate lubricant between two tests achieved with the reference lubricant. This gives the possibility of guaranteeing the operation stability of the engine as well as the statistically significant nature of the measured consumption differences between lubricants, In the present case, the reference lubricant is a commercial oil for semi-rapid 4 stroke engines of viscosity grades SAE40 and BN 30.

The comparative composition $C_3$ and the composition according to the invention $L_1$ have been evaluated.

The results, representing the fuel consumption gain for the different tested engine loads are grouped together in table V.

TABLE V

| | Fuel consumption gain (%) | | | |
|---|---|---|---|---|
| | $C_3$ (comparative) | $L_1$ (invention) | $L_2$ (invention) | $L_3$ (invention) |
| With an engine load of 100% | nd | 1.09 | 1.07 | 1.29 |
| With an engine load of 75% | 0.7 | 1.38 | 1.40 | 1.13 |
| With an engine load of 25% | nd | 2.70 | nd | 2.72 |

nd: not determined

It is seen that the combination of a hydrogenated and linear styrene/butadiene copolymer and of a copolymer olefin allows, in the lubricant compositions $L_1$, $L_2$ and $L_3$, a reduction of more than 1% of the fuel consumption with a load of 75% but also of more than 100% relatively to the reference oil unlike the composition $C_3$ (comparative) comprising the combination of a hydrogenated styrene/isoprene copolymer and of a copolymer olefin which exclusively allows a reduction of 0.7% of the fuel consumption with a load of 75% relatively to the reference oil.

Further, it was observed that the general aspect of the engine and of the cases after the test giving the possibility of demonstrating the fuel savings have low fouling, notably with visual scores of 7.5 over 10 for the case cleanliness and of 69.3 over 100 for the piston cleanliness, which is compliant with the reference oil, notably with 4-stroke marine engines, which also have low fouling, notably with visual scores of 7.5 over 10 for the case cleanliness and of 69.2 over 100 for the piston cleanliness.

Thus, the examples above show that the lubricant compositions according to the invention have both a good heat resistance and therefore give the possibility of improving the engine cleanliness, while significantly reducing the fuel consumption, notably of fuel.

The invention claimed is:

1. A lubricant composition comprising:

at least one base oil selected from the group consisting of oils of the group I, oils of the group II and mixtures thereof, according to the classes defined in the API classification;

at least one detergent, in an amount being from 10% to 20% by mass based on the total mass of said lubricant composition;

at least one olefin copolymer; and at least one hydrogenated and linear styrene/butadiene copolymer;

wherein said at least one detergent is selected from the group consisting of alkaline or alkaline-earth of carboxylate and phenate detergents, wherein the amount of olefin copolymer is from 0.01 to 5% by mass and the amount of styrene/butadiene copolymer is from 2 to 8% by mass, wherein said at least one olefin copolymer is an ethylene-propylene copolymer and comprises a content of ethylene units ranging from 30% to 80% by mass based on the mass of copolymer olefin, and wherein in the hydrogenated and linear styrene/butadiene copolymer, the content of hydrogenated butadiene units ranges from 50% to 98% by moles, as compared with the number of moles of hydrogenated and linear styrene/butadiene copolymer.

2. A process for lubricating 4-stroke or 2-stroke marine engines, comprising the lubrication of the engine with a lubricant composition according to claim 1.

3. A process for reducing the fuel consumption while improving the cleanliness of 4-stroke or 2-stroke marine engines comprising contacting the lubricant composition according to claim 1 with the marine engine or the stationary engine.

4. The process according to claim 3, wherein the marine engine is a 4-stroke marine engine.

5. The lubricant composition according to claim 1, wherein in the hydrogenated and linear styrene/butadiene copolymer, the content of hydrogenated butadiene units ranges from 60% to 98% by moles, as compared with the number of moles of hydrogenated and linear styrene/butadiene copolymer.

6. The lubricant composition according to claim 1, wherein in the hydrogenated and linear styrene/butadiene copolymer, the content of hydrogenated butadiene units ranges from 70% to 97% by moles, as compared with the number of moles of hydrogenated and linear styrene/butadiene copolymer.

7. The lubricant composition according to claim 1, wherein the weight content of hydrogenated and linear styrene/butadiene copolymer is from 5% to 8% by mass, based on the total mass of the lubricant composition.

8. The lubricant composition according to claim 1, wherein the ethylene/propylene copolymer comprises a content of ethylene units ranging from 30% to 70% by mass based on the mass of copolymer olefin.

9. The lubricant composition according to claim 1, wherein the ethylene/propylene copolymer comprises a content of ethylene units ranging from 40% to 70% by mass based on the mass of copolymer olefin.

10. The lubricant composition according to claim 1, wherein the amount of olefin copolymer is from 0.01% to 2% by mass, based on the total mass of the lubricant composition.

11. The lubricant composition according to claim 1, wherein the amount of olefin copolymer is from 0.01% to 1% by mass, based on the total mass of the lubricant composition.

* * * * *